US010085081B2

(12) United States Patent
Woo et al.

(10) Patent No.: US 10,085,081 B2
(45) Date of Patent: Sep. 25, 2018

(54) ELECTRONIC DEVICE AND METHOD FOR CONTROLLING POWER

(71) Applicant: Samsung Electronics Co., Ltd., Suwon-si (KR)

(72) Inventors: Kwang-Taek Woo, Daegu (KR); Jung-Je Park, Busan (KR); Tae-Ho Kwon, Daegu (KR); Byoung-Kug Kim, Gumi-si (KR); Deuk-Kyu Oh, Daegu (KR); Yong-Gil Han, Gumi-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 15/074,528

(22) Filed: Mar. 18, 2016

(65) Prior Publication Data

US 2016/0277827 A1 Sep. 22, 2016

(30) Foreign Application Priority Data

Mar. 18, 2015 (KR) ..... 10-2015-0037538

(51) Int. Cl.
*H04R 1/10* (2006.01)

(52) U.S. Cl.
CPC ..... *H04R 1/1041* (2013.01); *H04R 2460/03* (2013.01)

(58) Field of Classification Search
CPC ..... H04R 1/10
See application file for complete search history.

(56) References Cited

U.S. PATENT DOCUMENTS

2005/0164631 A1 7/2005 Jin
2008/0089535 A1* 4/2008 Hong ..... H03G 3/002 381/109
2010/0075723 A1* 3/2010 Min ..... H01R 24/58 455/569.1
2010/0303251 A1* 12/2010 Im ..... H04R 1/1041 381/74
2013/0051589 A1* 2/2013 Ide ..... H04R 1/1025 381/309
2014/0055167 A1* 2/2014 Oh ..... G01R 31/024 327/63
2014/0064512 A1* 3/2014 Yu ..... H01R 24/58 381/74
2014/0185821 A1* 7/2014 Ushakov ..... H04R 1/1033 381/74
2015/0078577 A1* 3/2015 Cimaz ..... H04R 29/004 381/74
2015/0281825 A1* 10/2015 Johnson ..... H04R 5/04 381/74

(Continued)

FOREIGN PATENT DOCUMENTS

KR 20010036887 5/2001
KR 10-2005-0076845 7/2005

*Primary Examiner* — Olisa Anwah
(74) *Attorney, Agent, or Firm* — McAndrews, Held & Malloy, Ltd.

(57) ABSTRACT

The present disclosure relates to electronic devices and methods for controlling power supplied to earphones. According to an embodiment of the present disclosure, a method for controlling power by an electronic device may comprise applying a power to an earphone corresponding to sensing a coupling of the earphone, adjusting the power applied to the earphone corresponding to sensing an input through a button of an earphone, and applying the adjusted power.

14 Claims, 14 Drawing Sheets

(56) References Cited

U.S. PATENT DOCUMENTS

| | | | | |
|---|---|---|---|---|
| 2015/0304764 | A1* | 10/2015 | Lin | H04R 1/1041 381/74 |
| 2016/0080854 | A1* | 3/2016 | Chen | H04R 1/1041 381/74 |
| 2016/0094907 | A1* | 3/2016 | Xiao | H04R 1/1041 381/74 |
| 2016/0100248 | A1* | 4/2016 | Mehrabi | H04R 3/00 381/384 |
| 2016/0171969 | A1* | 6/2016 | Lee | H04R 1/1041 381/71.6 |
| 2016/0192054 | A1* | 6/2016 | Lee | H04R 1/1041 381/71.6 |
| 2016/0205457 | A1* | 7/2016 | Whitney | H04R 1/1033 381/380 |
| 2016/0277826 | A1* | 9/2016 | Hsieh | H04R 5/04 |
| 2016/0277827 | A1* | 9/2016 | Woo | H04R 1/1041 |

* cited by examiner

ELECTRONIC DEVICE AND METHOD FOR CONTROLLING POWER

RELATED APPLICATION(S)

This application claims the benefit under 35 U.S.C. § 119(a) of a Korean patent application filed in the Korean Intellectual Property Office on Mar. 18, 2015 and assigned Serial No. 10-2015-0037538, the entire disclosure of which is incorporated herein by reference.

BACKGROUND

The present disclosure relates to electronic devices and methods for controlling power supplied to earphones.

Recently, electronic devices are providing more diversified services and additional functions. To meet users' various needs and raise use efficiency of electronic devices, communication service carriers or device manufacturers are jumping into competitions to develop electronic devices with differentiated and diversified functionalities. As a result, electronic devices provide users with a diversity of services including wired/wireless Internet access, emailing, capturing images, and playing music, movie, or other multimedia files.

Thus, users may enjoy multimedia services anytime anywhere without time and space limitations. Typically, a headset or an earphone may be used to avoid any annoyance to others around when receiving a multimedia service. An earphone (e.g., a 4-pole earphone) may include a speaker to output voice or audible signal, and a microphone to receive voice. The earphone (e.g., a 4-pole earphone) may also include a number of buttons including volume-up/down buttons and a call taking button. An electronic device senses the coupling of an earphone and controls the output of sounds through the earphone. The electronic device may sense the microphone of the earphone using a comparator or an analog-to-digital converter (ADC). The method of using a comparator enables such sensing through a low signal generated when the earphone couples, and the method of using an ADC enables by converting a received analog voice or audible signal into a digital signal.

According to the conventional art, when a 4-pole earphone is put in an electronic device, a predetermined level of power (e.g., 2.8V) is supplied to the earphone to sense a button of a remote controller of the earphone, and an amount of current typically between 0.5 mA and 0.7 mA may be consumed.

Accordingly, there is a need for minimizing current consumption by supplying minimum power when the button of the remote controller of the earphone is not selected while supplying operation power when the button is selected.

The above information is presented as background information only to assist with an understanding of the present disclosure. No determination has been made, and no assertion is made, as to whether any of the above might be applicable as prior art with regard to the present disclosure.

SUMMARY

Embodiments of the present disclosure relate to electronic devices and methods for controlling power supplied to earphones.

According to an embodiment of the present disclosure, a method for controlling power by an electronic device may comprise applying a power to an earphone corresponding to sensing a coupling of the earphone, adjusting the power applied to the earphone corresponding to sensing an input through a button of an earphone, and applying the adjusted power to the earphone.

According to an embodiment of the present disclosure, a method for controlling power supplied to an earphone of an electronic device may comprise applying a first power to an earphone corresponding to sensing a coupling of the earphone, receiving a control signal corresponding to sensing an input through a button of an earphone, adjusting the power applied to the earphone to a second power corresponding to receiving the control signal, converting an analog value for the button into a digital value, and executing a function corresponding to the digital value.

According to an embodiment of the present disclosure, an electronic device for controlling power supplied to an earphone may comprise an earphone including a button, a power supply supplying power to the earphone, and a processor applying the power to the earphone corresponding to sensing a coupling of the earphone, adjusting the power applied to the earphone corresponding to sensing an input through the button of the earphone, and applying the adjusted power to the earphone.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

Throughout the drawings, like reference numerals will be understood to refer to like parts, components, and structures.

DETAILED DESCRIPTION

Figure 1:
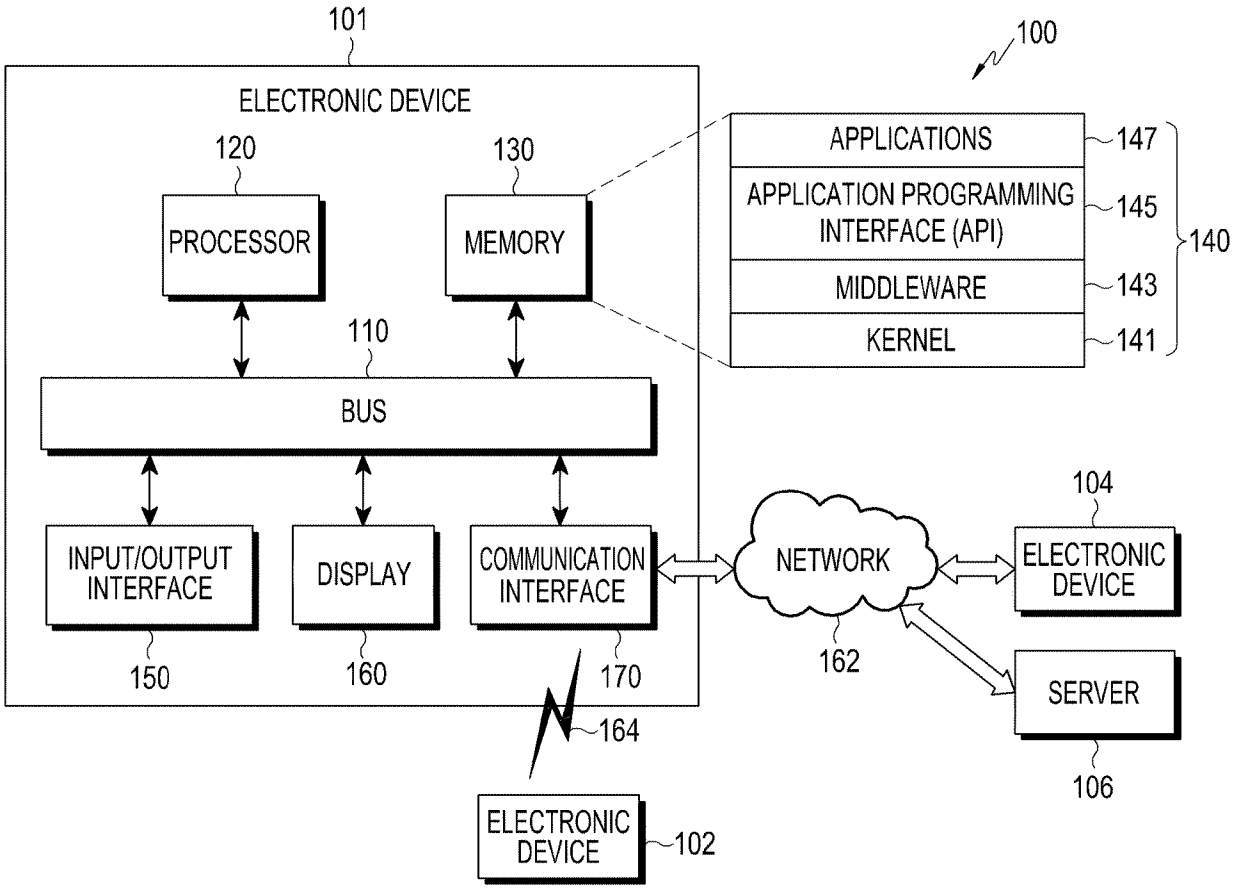
FIG. 1 is a view illustrating an electronic device in a network environment according to an embodiment of the present disclosure.

Hereinafter, embodiments of the present disclosure are described with reference to the accompanying drawings. However, it should be appreciated that the present disclosure is not limited to the embodiments, and all changes and/or equivalents or replacements thereto also belong to the scope of the present disclosure. The same or similar reference denotations may be used to refer to the same or similar elements throughout the specification and the drawings.

As used herein, the terms "have," "may have," "include," or "may include" a feature (e.g., a number, function, operation, or a component such as a part) indicate the existence of the feature and do not exclude the existence of other features.

As used herein, the terms "A or B," "at least one of A and/or B," or "one or more of A and/or B" may include all possible combinations of A and B. For example, "A or B," "at least one of A and B," "at least one of A or B" may indicate all of (1) including at least one A, (2) including at least one B, or (3) including at least one A and at least one B.

As used herein, the terms "first" and "second" may modify various components regardless of importance and/or order and are used to distinguish a component from another without limiting the components. For example, a first user device and a second user device may indicate different user devices from each other regardless of the order or importance of the devices. For example, a first component may be denoted a second component, and vice versa without departing from the scope of the present disclosure.

It will be understood that when an element (e.g., a first element) is referred to as being (operatively or communicatively) "coupled with/to," or "connected with/to" another element (e.g., a second element), it can be coupled or connected with/to the other element directly or via a third element. In contrast, it will be understood that when an element (e.g., a first element) is referred to as being "directly coupled with/to" or "directly connected with/to" another element (e.g., a second element), no other element (e.g., a third element) intervenes between the element and the other element.

As used herein, the terms "configured (or set) to" may be interchangeably used with the terms "suitable for," "having the capacity to," "designed to," "adapted to," "made to," or "capable of" depending on circumstances. The term "configured (or set) to" does not essentially mean "specifically designed in hardware to." Rather, the term "configured to" may mean that a device can perform an operation together with another device or parts. For example, the term "processor configured (or set) to perform A, B, and C" may mean a generic-purpose processor (e.g., a central processing unit (CPU) or application processor) that may perform the operations by executing one or more software programs stored in a memory device or a dedicated processor (e.g., an embedded processor) for performing the operations.

The terms as used herein are provided merely to describe some embodiments thereof, but not to limit the scope of other embodiments of the present disclosure. It is to be understood that the singular forms "a," "an," and "the" include plural references unless the context clearly dictates otherwise. The terms including technical and scientific terms used herein have the same meaning as commonly understood by one of ordinary skill in the art to which the embodiments of the present disclosure belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In some cases, the terms defined herein may be interpreted to exclude embodiments of the present disclosure.

For example, examples of the electronic device according to embodiments of the present disclosure may include at least one of a smartphone, a tablet personal computer (PC), a mobile phone, a video phone, an e-book reader, a desktop PC, a laptop computer, a netbook computer, a workstation, a personal digital assistant (PDA), a portable multimedia player (PMP), an MP3 player, a mobile medical device, a camera, or a wearable device. According to an embodiment of the present disclosure, the wearable device may include at least one of an accessory-type device (e.g., a watch, a ring, a bracelet, an anklet, a necklace, glasses, contact lenses, or a head-mounted device (HMD)), a fabric- or clothes-integrated device (e.g., electronic clothes), a body attaching-type device (e.g., a skin pad or tattoo), or a body implantable device (e.g., an implantable circuit).

According to an embodiment of the present disclosure, the electronic device may be a home appliance. For example, examples of the smart home appliance may include at least one of a television, a digital video disk (DVD) player, an audio player, a refrigerator, an air conditioner, a cleaner, an oven, a microwave oven, a washer, a drier, an air cleaner, a set-top box, a home automation control panel, a security control panel, a TV box (e.g., Samsung HomeSync™, Apple TV™, or Google TV™), a gaming console (Xbox™, PlayStation™), an electronic dictionary, an electronic key, a camcorder, or an electronic picture frame.

According to an embodiment of the present disclosure, examples of the electronic device may include at least one of various medical devices (e.g., diverse portable medical measuring devices (a blood sugar measuring device, a heartbeat measuring device, or a body temperature measuring device), a magnetic resource angiography (MRA) device, a magnetic resource imaging (MRI) device, a computed tomography (CT) device, an imaging device, or an ultrasonic device), a navigation device, a global navigation satellite system (GNSS) receiver, an event data recorder (EDR), a flight data recorder (FDR), an automotive infotainment device, an sailing electronic device (e.g., a sailing navigation device or a gyro compass), avionics, security devices, vehicular head units, industrial or home robots, automatic teller's machines (ATMs), point-of-sales (POS) devices, or Internet of Things devices (e.g., a bulb, various sensors, an electric or gas meter, a sprinkler, a fire alarm, a thermostat, a street light, a toaster, fitness equipment, a hot water tank, a heater, or a boiler).

According to various embodiments of the disclosure, examples of the electronic device may at least one of part of furniture or building/structure, an electronic board, an electronic signature receiving device, a projector, or various measurement devices (e.g., devices for measuring water, electricity, gas, or electromagnetic waves). According to an embodiment of the present disclosure, the electronic device may be one or a combination of the above-listed devices. According to an embodiment of the present disclosure, the electronic device may be a flexible electronic device. The electronic device disclosed herein is not limited to the above-listed devices, and may include new electronic devices depending on the development of technology.

Hereinafter, electronic devices are described with reference to the accompanying drawings, according to various embodiments of the present disclosure. As used herein, the term "user" may denote a human or another device (e.g., an artificial intelligent electronic device) using the electronic device.

Referring to FIG. 1, according to an embodiment of the present disclosure, an electronic device 101 is included in a network environment 100.

The electronic device 101 may include a bus 110, a processor 120, a memory 130, an input/output interface 150, a display 160, and a communication interface 170. In some embodiments, the electronic device 101 may exclude at least one of the components or may add another component.

The bus 110 may include a circuit to connect the processor 120 to the memory 130, the input/output interface 150, the display 160, and the communication interface 170 and transfer communications (e.g., control messages and/or data) between components of the electronic device 101.

The processor 120 may include one or more of a central processing unit (CPU), an application processor (AP), or a communication processor (CP). The processor 120 may perform control on at least one of the other components of the electronic device 101, and/or perform an operation or data processing relating to communication.

The memory 130 may include a volatile and/or non-volatile memory. For example, the memory 130 may store commands or data related to at least one other component of the electronic device 101. According to an embodiment of the present disclosure, the memory 130 may store software and/or a program 140. The program 140 may include, e.g., a kernel 141, middleware 143, an application programming interface (API) 145, and/or an application program (or "application") 147. At least a portion of the kernel 141, middleware 143, or API 145 may be denoted an operating system (OS).

For example, the kernel 141 may control or manage system resources (e.g., the bus 110, processor 120, or a memory 130) used to perform operations or functions implemented in other programs (e.g., the middleware 143, API 145, or application 147). The kernel 141 may provide an interface that allows the middleware 143, the API 145, or the application 147 to access the individual components of the electronic device 101 to control or manage the system resources.

The middleware 143 may function as a relay to allow the API 145 or the application 147 to communicate data with the kernel 141, for example.

Further, the middleware 143 may process one or more task requests received from the application 147 in order of priority. For example, the middleware 143 may assign the application 147 with priority of using system resources (e.g., the bus 110, processor 120, or memory 130) of the electronic device 101. For example, the middleware 143 may perform scheduling or load balancing on the one or more task requests by processing the one or more task requests according to the priority assigned to the application 147.

The API 145 is an interface allowing the application 147 to control functions provided from the kernel 141 or the middleware 143. For example, the API 133 may include at least one interface or function (e.g., a command) for filing control, window control, image processing or text control.

The input/output interface 150 may serve as an interface that may, e.g., transfer commands or data input from a user or other external devices to other component(s) of the electronic device 101. Further, the input/output interface 150 may output commands or data received from other component(s) of the electronic device 101 to the user or the other external device.

The display 160 may include, e.g., a liquid crystal display (LCD), a light emitting diode (LED) display, an organic light emitting diode (OLED) display, or a microelectromechanical systems (MEMS) display, or an electronic paper display. The display 160 may display, e.g., various contents (e.g., text, images, videos, icons, or symbols) to the user. The display 160 may include a touchscreen and may receive, e.g., a touch, gesture, proximity or hovering input using an electronic pen or a body portion of the user.

For example, the communication interface 170 may set up communication between the electronic device 101 and an external electronic device (e.g., a first electronic device 102, a second electronic device 104, or a server 106). For example, the communication interface 170 may be connected with the network 162 through wireless or wired communication to communicate with the external electronic device.

The wireless communication may be a cellular communication protocol and may use at least one of, e.g., long-term evolution (LTE), long-term evolution-advanced (LTE-A), code division multiple access (CDMA), wideband CDMA (WCDMA), universal mobile telecommunications system (UMTS), wireless broadband (WiBro), or global system for mobile communications (GSM). Further, the wireless communication may include, e.g., short-range communication 164. The short-range communication 164 may include at least one of wireless fidelity (Wi-Fi), Bluetooth, near-field communication (NFC), or global navigation satellite system (GNSS). The GNSS may include at least one of, e.g., global positioning system (GPS), global navigation satellite system (Glonass), Beidou navigation satellite system (Beidou) or Galileo, or the European global satellite-based navigation system. Hereinafter, the terms "GPS" and the "GNSS" may be interchangeably used herein. The wired connection may include at least one of, e.g., universal serial bus (USB), high definition multimedia interface (HDMI), recommended standard (RS-232), or plain old telephone service (POTS). The network 162 may include at least one of telecommunication networks, e.g., a computer network (e.g., a local area network (LAN) or a wide area network (WAN)), Internet, or a telephone network.

The first electronic device 102 and the second electronic device 104 each may be a device of the same or a different type from the electronic device 101. According to an embodiment of the present disclosure, the server 106 may include a group of one or more servers. According to an embodiment of the present disclosure, all or some of operations executed on the electronic device 101 may be executed on another or multiple other electronic devices (e.g., the first electronic device 102 and the second electronic device 104, or the server 106). According to an embodiment of the present disclosure, when the electronic device 101 should perform some function or service automatically or at a request, the electronic device 101, instead of executing the function or service on its own or additionally, may request another device (e.g., the first electronic device 102 and the second electronic device 104, or the server 106) to perform at least some functions associated therewith. The other electronic device (e.g., the first electronic device 102 and the second electronic device 104, or the server 106) may execute the requested functions or additional functions and transfer a result of the execution to the electronic device 101. The electronic device 101 may provide a requested function or service by processing the received result as it is or additionally. To that end, a cloud computing, distributed computing, or client-server computing technique may be used, for example.

Figure 2:
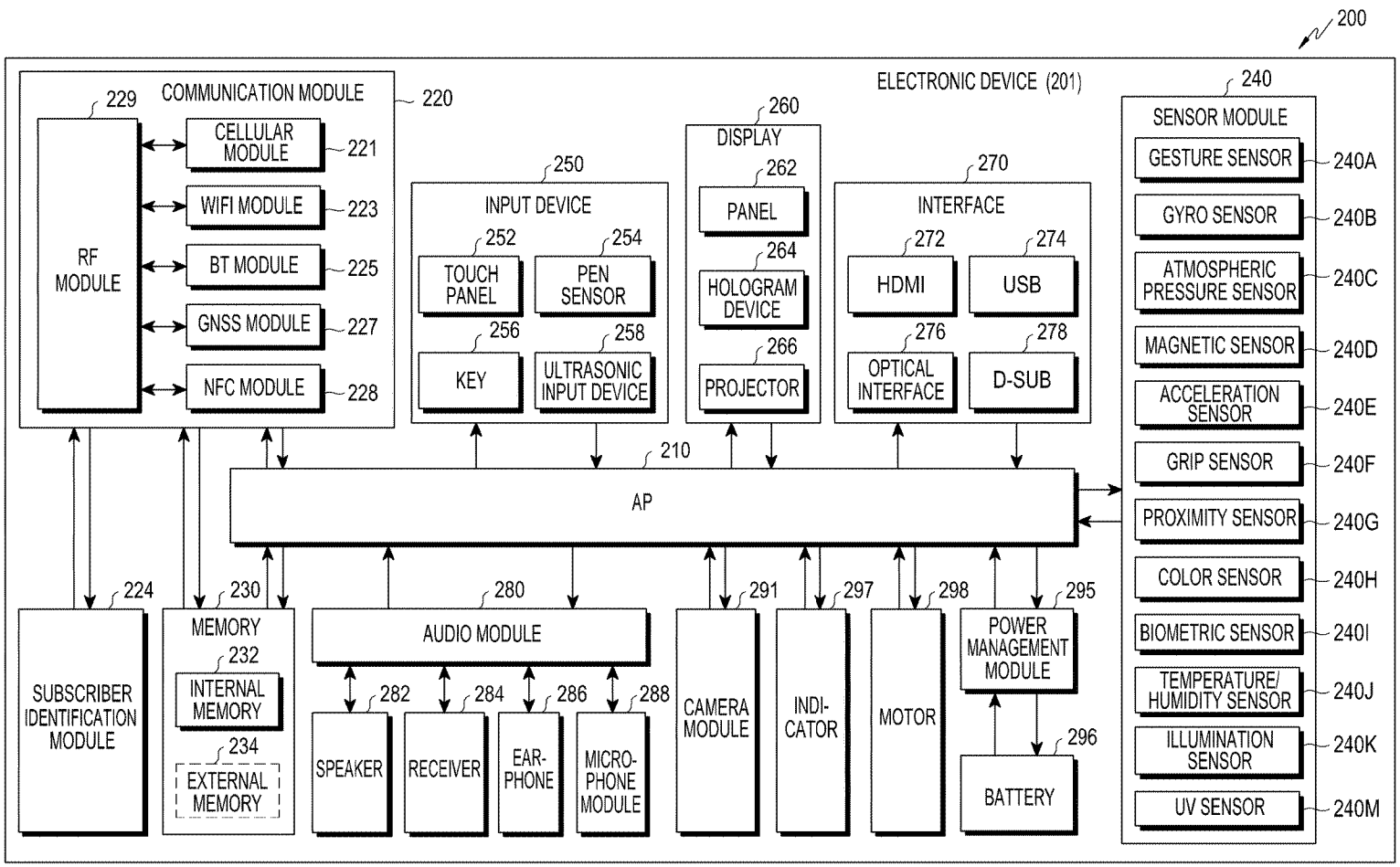
FIG. 2 is a block diagram illustrating an electronic device according to an embodiment of the present disclosure.

FIG. 2 is a block diagram illustrating an electronic device according to an embodiment of the present disclosure.

The electronic device 201 may include the whole or part of the configuration of, e.g., the electronic device 101 shown in FIG. 1. The electronic device 201 may include a processor 210 (e.g., application processors (APs)), a communication module 220, a subscriber identification module (SIM) 224, a memory 230, a sensor module 240, an input device 250, a display 260, an interface 270, an audio module 280, a camera module 291, a power management module 295, a battery 296, an indicator 297, and a motor 298.

The processor 210 may control some hardware and multiple software components connected to the processor 210 by executing, e.g., an operating system or application programs, and the processor 210 may process and compute various data. The processor 210 may be implemented in, e.g., a system-on-chip (SoC). According to an embodiment of the present disclosure, the processor 210 may further include a graphic processing unit (GPU) and/or an image signal processor. The processor 210 may include at least some (e.g., the cellular module 221) of the components shown in FIG. 2. The processor 210 may load a command or data received from at least one of other components (e.g., a non-volatile memory) on a volatile memory, process the command or data, and store various data in the non-volatile memory.

The communication module 220 may have the same or similar configuration to the communication interface 170 of FIG. 1. The communication module 220 may include, e.g., a cellular module 221, a Wi-Fi module 223, a Bluetooth module 225, a GNSS module 227 (e.g., a GPS module, a Glonass module, a Beidou module, or a Galileo module), an NFC module 228, and a radio frequency (RF) module 229.

The cellular module 221 may provide voice call, video call, text, or Internet services through, e.g., a communication network. The cellular module 221 may perform identification or authentication on the electronic device 201 in the communication network using a subscriber identification module 224 (e.g., the SIM card). According to an embodiment of the present disclosure, the cellular module 221 may perform at least some of the functions providable by the processor 210. According to an embodiment of the present disclosure, the cellular module 221 may include a communication processor (CP).

The Wi-Fi module 223, the Bluetooth module 225, the GNSS module 227, or the NFC module 228 may include a process for, e.g., processing data communicated through the module. At least some (e.g., two or more) of the cellular module 221, the Wi-Fi module 223, the Bluetooth module 225, the GNSS module 227, or the NFC module 228 may be included in a single integrated circuit (IC) or an IC package.

The RF module 229 may communicate data, e.g., communication signals (e.g., RF signals). The RF module 229 may include, e.g., a transceiver, a power amp module (PAM), a frequency filter, a low noise amplifier (LNA), or an antenna. According to an embodiment of the present disclosure, at least one of the cellular module 221, the Wi-Fi module 223, the Bluetooth module 225, the GNSS module 227, or the NFC module 228 may communicate RF signals through a separate RF module.

The subscriber identification module 224 may include, e.g., a card including a subscriber identification module and/or an embedded SIM, and may contain unique identification information (e.g., an integrated circuit card identifier (ICCID) or subscriber information (e.g., an international mobile subscriber identity (IMSI)).

The memory 230 (e.g., the memory 130) may include, e.g., an internal memory 232 or an external memory 234. The internal memory 232 may include at least one of, e.g., a volatile memory (e.g., a dynamic random access memory (DRAM), a static random access memory (SRAM), a synchronous dynamic random access memory (SDRAM), etc.) or a non-volatile memory (e.g., a one-time programmable read only memory (OTPROM), a programmable read only memory (PROM), an erasable and programmable read only memory (EPROM), an electrically erasable and programmable read only memory (EEPROM), a mask ROM, a flash read only memory, a flash memory (e.g., a Not AND (NAND) flash, or a Not OR (NOR) flash), a hard drive, or solid state drive (SSD).

The external memory 234 may include a flash drive, e.g., a compact flash (CF) memory, a secure digital (SD) memory, a micro-SD memory, a min-SD memory, an extreme digital (xD) memory, a multi-media card (MMC), or a memory Stick™. The external memory 234 may be functionally and/or physically connected with the electronic device 201 via various interfaces.

For example, the sensor module 240 may measure a physical quantity or detect an operational state of the electronic device 201, and the sensor module 240 may convert the measured or detected information into an electrical signal. The sensor module 240 may include at least one of, e.g., a gesture sensor 240A, a gyro sensor 240B, an atmospheric pressure sensor 240C, a magnetic sensor 240D, an acceleration sensor 240E, a grip sensor 240F, a proximity sensor 240G, a color or RGB sensor 240H (e.g., an Red-Green-Blue (RGB) sensor), a biometric sensor 240I, a temperature/humidity sensor 240J, an illumination sensor 240K, or an Ultra Violet (UV) sensor 240M. Additionally or alternatively, the sensor module 240 may include, e.g., an E-nose sensor, an electromyography (EMG) sensor, an electroencephalogram (EEG) sensor, an electrocardiogram (ECG) sensor, an infrared (IR) sensor, an iris sensor, or a finger print sensor. The sensor module 240 may further include a control circuit for controlling at least one or more of the sensors included in the sensing module. According to an embodiment of the present disclosure, the electronic device 201 may further include a processor configured to control the sensor module 240, as a part of the processor 210 or separately from the processor 210, and the electronic device 101 may control the sensor module 240 while the processor 210 is in a sleep mode.

The input device 250 may include, e.g., a touch panel 252, a (digital) pen sensor 254, a key 256, or an ultrasonic input device 258. The touch panel 252 may use at least one of capacitive, resistive, infrared, or ultrasonic methods. The touch panel 252 may further include a control circuit. The touch panel 252 may further include a tactile layer and may provide a user with a tactile reaction.

The (digital) pen sensor 254 may include, e.g., a part of a touch panel or a separate sheet for recognition. The key 256 may include e.g., a physical button, optical key or key pad. The ultrasonic input device 258 may sense an ultrasonic wave generated from an input tool through a microphone (e.g., the microphone 288) to identify data corresponding to the sensed ultrasonic wave.

The display 260 (e.g., the display 160) may include a panel 262, a hologram device 264, or a projector 266. The panel 262 may have the same or similar configuration to the display 160 of FIG. 1. The panel 262 may be implemented to be flexible, transparent, or wearable. The panel 262 may also be incorporated with the touch panel 252 in a module. The hologram device 264 may make three dimensional (3D) images (holograms) in the air by using light interference. The projector 266 may display an image by projecting light onto a screen. The screen may be, for example, located inside or outside of the electronic device 201. In accordance with an embodiment, the display 260 may further include a control circuit to control the panel 262, the hologram device 264, or the projector 266.

The interface 270 may include e.g., a high definition multimedia interface (HDMI) 272, a USB 274, an optical interface 276, or a D-subminiature (D-sub) 278. The interface 270 may be included in e.g., the communication interface 170 shown in FIG. 1. Additionally or alternatively, the interface 270 may include a Mobile High-definition Link (MHL) interface, a secure digital (SD) card/multimedia card (MMC) interface, or Infrared Data Association (IrDA) standard interface.

The audio module 280 may convert a sound into an electric signal or vice versa, for example. At least a part of the audio module 280 may be included in e.g., the input/output interface 150 as shown in FIG. 1. The audio module 280 may process sound information input or output through e.g., a speaker 282, a receiver 284, an earphone 286, or a microphone 288.

For example, the camera module 291 may be a device for capturing still images and videos, and may include, according to an embodiment of the present disclosure, one or more image sensors (e.g., front and back sensors), a lens, an Image Signal Processor (ISP), or a flash such as an LED or xenon lamp.

The power management module 295 may manage power of the electronic device 201, for example. Although not shown, according to an embodiment of the present disclosure, the power management module 295 may include a power management integrated circuit (PMIC), a charger IC, or a battery or fuel gauge. The PMIC may have a wired and/or wireless recharging scheme. The wireless charging scheme may include e.g., a magnetic resonance scheme, a magnetic induction scheme, or an electromagnetic wave based scheme, and an additional circuit, such as a coil loop, a resonance circuit, a rectifier, or the like may be added for wireless charging. The battery gauge may measure an amount of remaining power of the battery 296, a voltage, a current, or a temperature while the battery 296 is being charged. The battery 296 may include, e.g., a rechargeable battery or a solar battery.

The indicator 297 may indicate a particular state of the electronic device 201 or a part (e.g., the processor 210) of the electronic device, including e.g., a booting state, a message state, or recharging state. The motor 298 may convert an electric signal to a mechanical vibration and may generate a vibrational or haptic effect. Although not shown, a processing unit for supporting mobile TV, such as a GPU may be included in the electronic device 201. The processing unit for supporting mobile TV may process media data conforming to a standard for digital multimedia broadcasting (DMB), digital video broadcasting (DVB), or media-Flo™.

Each of the aforementioned components of the electronic device may include one or more parts, and a name of the part may vary with a type of the electronic device. The electronic device in accordance with various embodiments of the present disclosure may include at least one of the aforementioned components, omit some of them, or include other additional component(s). Some of the components may be combined into an entity, but the entity may perform the same functions as the components may do.

Figure 3:
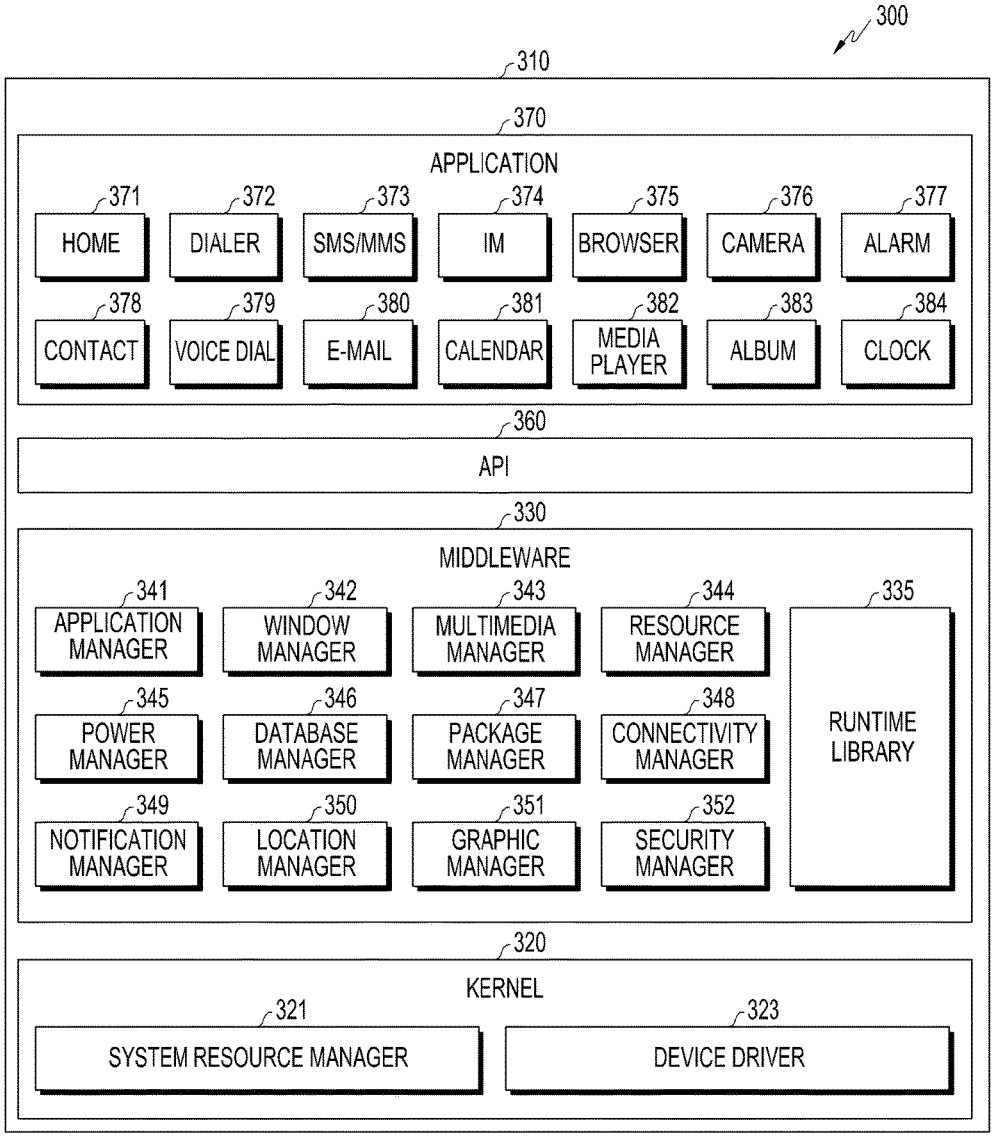
FIG. 3 is a block diagram illustrating a program module according to an embodiment of the present disclosure.

FIG. 3 is a block diagram illustrating a program module according to an embodiment of the present disclosure.

According to an embodiment of the present disclosure, the program module 310 (e.g., the program 140) may include an operating system (OS) controlling resources related to the electronic device (e.g., the electronic device 101) and/or various applications (e.g., the application 147) driven on the operating system. The operating system may include, e.g., Android, iOS, Windows, Symbian, Tizen, or Bada.

The program module 310 may include, e.g., a kernel 320, middleware 330, an application programming interface (API) 360, and/or an application 370. At least a part of the program module 310 may be preloaded on the electronic device or may be downloaded from an external electronic device (e.g., the first electronic device 102 and the second electronic device 104, or the server 106).

The kernel 320 (e.g., the kernel 141) may include, e.g., a system resource manager 321 and/or a device driver 323. The system resource manager 321 may perform control, allocation, or recovery of system resources. According to an embodiment of the present disclosure, the system resource manager 321 may include a process managing unit, a memory managing unit, or a file system managing unit. The device driver 323 may include, e.g., a display driver, a camera driver, a Bluetooth driver, a shared memory driver, a USB driver, a keypad driver, a Wi-Fi driver, an audio driver, or an inter-process communication (IPC) driver.

The middleware 330 may provide various functions to the application 370 through the API 360 so that the application 370 may efficiently use limited system resources in the electronic device or provide functions jointly required by the application 370. According to an embodiment of the present disclosure, the middleware 330 (e.g., middleware 143) may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, or a security manager 352.

The runtime library 335 may include a library module used by a compiler in order to add a new function through a programming language while, e.g., the application 370 is being executed. The runtime library 335 may perform input/output management, memory management, or operation on arithmetic functions.

The application manager 341 may manage the life cycle of the application 370. The window manager 342 may manage graphical user interface (GUI) resources used on the display 260 of FIG. 2. The multimedia manager 343 may grasp formats necessary to play various media files and use a codec appropriate for a format to perform encoding or decoding on media files. The resource manager 344 may manage resources, such as source code of the application 370, memory or storage space.

The power manager 345 may operate together with, e.g., a basic input/output system (BIOS) to manage battery or power and provide power information necessary for operating the electronic device 200 of FIG. 2. The database manager 346 may generate, search, or vary a database to be used in the application 370. The package manager 347 may manage installation or update of an application that is distributed in the form of a package file.

The connectivity manager 348 may manage wireless connectivity, such as, e.g., Wi-Fi or Bluetooth. The notification manager 349 may display or notify an event, such as a coming message, appointment, or proximity notification, to the user without interfering with the user. The location manager 350 may manage locational information on the electronic device 200. The graphic manager 351 may manage graphic effects to be offered to the user and their related user interface. The security manager 352 may provide various security functions necessary for system security or user authentication. According to an embodiment of the present disclosure, when the electronic device (e.g., the electronic device 101) has telephony capability, the middleware 330 may further include a telephony manager for managing voice call or video call functions of the electronic device 200.

The middleware 330 may include a middleware module forming a combination of various functions of the above-described components. The middleware 330 may provide a specified module per type of the operating system in order to provide a differentiated function. Further, the middleware 330 may dynamically omit some existing components or add new components.

The API 360 (e.g., the API 145) may be a set of, e.g., API programming functions and may have different configurations depending on operating systems. For example, in the case of Android or iOS, one API set may be provided per platform, and in the case of Tizen, two or more API sets may be offered per platform.

The application 370 (e.g., the application 147 of FIG. 1) may include one or more applications that may provide functions such as, e.g., a home 371, a dialer 372, a short message service (SMS)/multimedia messaging service (MMS) 373, an instant message (IM) 374, a browser 375, a camera 376, an alarm 377, a contact 378, a voice dial 379, an email 380, a calendar 381, a media player 382, an album 383, or a clock 384, a health-care (e.g., measuring the degree of workout or blood sugar), or provision of environmental information (e.g., provision of air pressure, moisture, or temperature information).

According to an embodiment of the present disclosure, the application 370 may include an application (hereinafter, "information exchanging application" for convenience) supporting information exchange between the electronic device (e.g., the electronic device 101 of FIG. 1, and the electronic device 200 of FIG. 2) and an external electronic device (e.g., the first electronic device 102 and the second electronic device 104 of FIG. 1). Examples of the information exchange application may include, but is not limited to, a notification relay application (e.g., the notification manager 349) for transferring specific information to the external electronic device, or a device management application for managing the external electronic device.

For example, the notification relay application (e.g., the notification manager 349) may include a function for relaying notification information generated from applications (e.g., the SMS/MMS application, email application, health-care application, or environmental information application) of the electronic device 101 of FIG. 1, and the electronic device 200 of FIG. 2 to the external electronic device (e.g., the first electronic device 102 and the second electronic device 104 of FIG. 1). Further, the notification relay application may receive notification information from, e.g., the external electronic device and may provide the received notification information to the user.

The device management application may perform at least some functions of the external electronic device (e.g., the first electronic device 102 and the second electronic device 104) communicating with the electronic device (e.g., turning on/off the external electronic device (or some components of the external electronic device) or control of brightness (or resolution) of the display), and the device management application may manage (e.g., install, delete, or update) an application operating in the external electronic device or a service (e.g., call service or message service) provided from the external electronic device.

According to an embodiment of the present disclosure, the application 370 may include an application (e.g., a health-care application of a mobile medical device (not shown)) designated according to an attribute of the external electronic device (e.g., the first electronic device 102 and the second electronic device 104). According to an embodiment of the present disclosure, the application 370 may include an application received from the external electronic device (e.g., the server 106 or the first electronic device 102 and the second electronic device 104). According to an embodiment of the present disclosure, the application 370 may include a preloaded application or a third party application downloadable from the server 106 of FIG. 1. The names of the components of the program module 310 according to the shown embodiment may be varied depending on the type of operating system.

According to an embodiment of the present disclosure, at least a part of the program module 310 may be implemented in software, firmware, hardware, or in a combination of two or more thereof. At least a part of the program module 310 may be implemented (e.g., executed) by e.g., a processor (e.g., the processor 210). At least a part of the program module 310 may include e.g., a module, program, routine, set of instructions, process, or the like for performing one or more functions.

The term 'module' may refer to a unit including one of hardware, software, and firmware, or a combination thereof. The term 'module' may be interchangeably used with a unit, logic, logical block, component, or circuit. The module may be a minimum unit or part of an integrated component. The module may be a minimum unit or part of performing one or more functions. The module may be implemented mechanically or electronically. For example, the module may include at least one of Application Specific Integrated Circuit (ASIC) chips, Field Programmable Gate Arrays (FPGAs), or Programmable Logic Arrays (PLAs) that perform some operations, which have already been known or will be developed in the future.

According to an embodiment of the present disclosure, at least a part of the device (e.g., modules or their functions) or method (e.g., operations) may be implemented as instructions stored in a computer-readable storage medium e.g., in the form of a program module. The instructions, when executed by a processor (e.g., the processor 120), may enable the processor to carry out a corresponding function. The computer-readable storage medium may be e.g., the memory 130.

The computer-readable storage medium, e.g., the memory 130, may include a hardware device, such as hard discs, floppy discs, and magnetic tapes (e.g., a magnetic tape), optical media such as Compact Disc ROMs (CD-ROMs) and Digital Versatile Discs (DVDs), magneto-optical media such as floptical disks, ROMs, RAMs, Flash Memories, and/or the like. Examples of the program instructions may include not only machine language codes but also high-level language codes which are executable by various computing means using an interpreter. The aforementioned hardware devices may be configured to operate as one or more software modules to carry out exemplary embodiments of the present disclosure, and vice versa.

Modules or programming modules in accordance with various embodiments of the present disclosure may include at least one or more of the aforementioned components, omit some of them, or further include other additional components. Operations performed by modules, programming modules or other components in accordance with various embodiments of the present disclosure may be carried out sequentially, simultaneously, repeatedly, or heuristically. Furthermore, some of the operations may be performed in a different order, or omitted, or include other additional operation(s). The embodiments disclosed herein are proposed for description and understanding of the disclosed technology and does not limit the scope of the present disclosure. Accordingly, the scope of the present disclosure should be interpreted as including all changes or various embodiments based on the technical spirit of the present disclosure.

Figure 4:
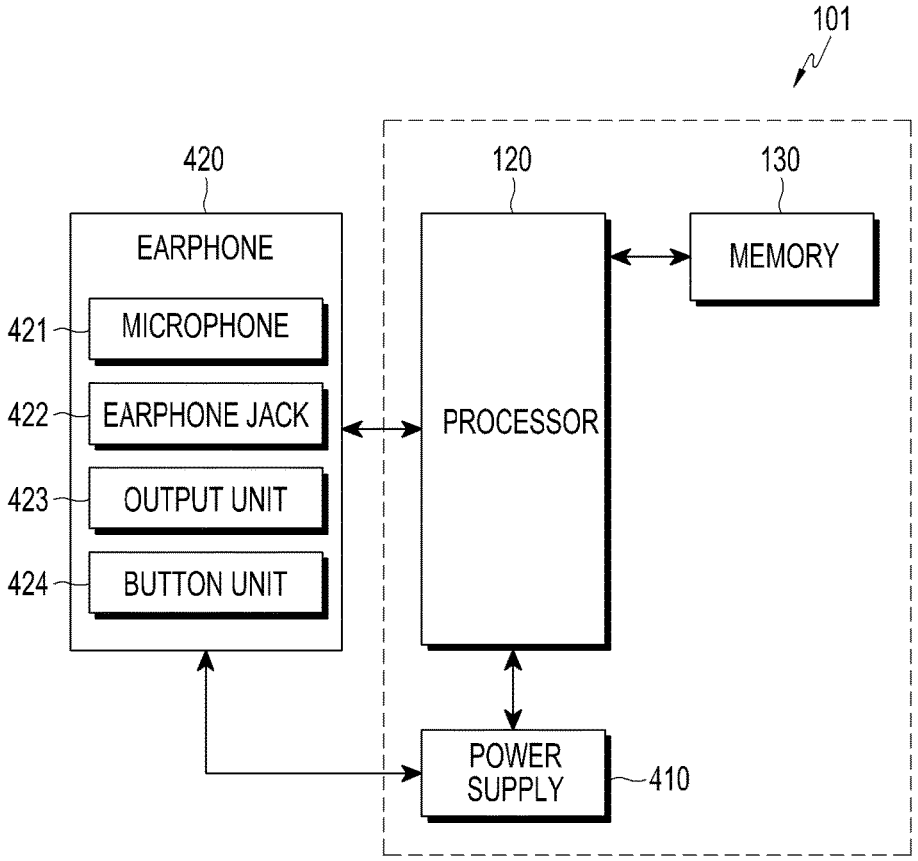
FIG. 4 is a block diagram illustrating an electronic device for controlling power supplied to an earphone according to an embodiment of the present disclosure.

FIG. 4 is a block diagram illustrating an electronic device for controlling power supplied to an earphone according to an embodiment of the present disclosure.

Referring to FIG. 4, according to an embodiment of the present disclosure, the electronic device 101 to control power supplied to an earphone may include a processor 120, a memory 130, and a power supply 410, and may be coupled to an earphone 420. The earphone 420 may couple or decouple from the electronic device 101.

The memory 130 may store data input/output through the earphone 420. The memory 130 may store data processed or necessary to be processed by the processor 120 and may store a digital value corresponding to at least one button configured in the earphone 420. The digital value may be a reference value required for the electronic device 101 to execute a function corresponding to the button.

The power supply 410 may include a battery 296 and a power management module 295. The power supply 410 may supply power to the earphone 420. The power supply 410 may supply power to the earphone 420 and adjust the strength of the power and supply the adjusted power to the earphone 420 under the control of the processor 120.

The earphone 420 may be included in the input/output interface 150. The earphone 420 may include a microphone 421 to receive a sound signal, an earphone jack 422 to couple the earphone 420 to the electronic device 101, an output unit 423 to output a sound signal, and a button unit 424 having at least one button. The microphone 421 may sense the user's voice and ambient sounds and may be included in the earphone 420. The earphone jack 422 may be configured with 4-pole terminals and may be inserted into an earphone coupling jack (not shown) of the electronic device 101. Upon insertion of the earphone jack 422, the electronic device 101 may transfer a sound signal to the earphone 420. The earphone 420 may transfer a sound signal sensed by the microphone 421 to the electronic device 101 and may transfer a control signal input by at least one button to the electronic device 101.

The processor 120 may apply power to the earphone 420 corresponding to sensing the coupling of the earphone 420, adjust power applied to the earphone 420 corresponding to sensing an input through a button of the earphone 420, and apply the adjusted power to the earphone 420. When the earphone jack 422 of the earphone 420 couples to the electronic device 101, the processor 120 may sense the coupling. The button may include at least one of a volume adjustment button, a call button, and a recording button. According to an embodiment of the present disclosure, although the button is described as including at least one of the volume adjustment button, the call button, and the recording button, this is merely an example, and other various buttons that may offer the user with convenience using the earphone may be alternatively provided. The button may sense or recognize a pressing or touch. The processor 120 may control the power supply 410 to apply power to the earphone 420 to determine whether an input is generated by pressing or touch at least one button of the earphone 420. The processor 120, upon sensing the input by the at least one button, may receive a control signal for the button from the earphone 420. The processor 120 may adjust the magnitude of power (or voltage) provided to the earphone 420 by controlling the power supply 410 and apply the adjusted power to the earphone 420. The processor 120 may adjust the magnitude of power (or voltage) applied to the earphone 420 using any one of an ON/OFF scheme or a register scheme. The ON/OFF scheme is a scheme of reducing the power applied to the earphone 420 to 0V and then adjusting a register value and applying the adjusted power, and the register scheme is a scheme of adjusting a register value and directly adjusting the applied power to the adjusted power. When receiving the control signal, the processor 120 may analyze an analog value applied after a predetermined time to determine what function the entered button may execute. The processor 120 may convert the analog value applied from the earphone 420 to a digital value after a predetermined time and compare the converted digital value with a per-button digital value previously stored in the memory 130 to determine which function the entered button is corresponding to. When the converted digital value corresponds to the sensed button input, the processor 120 may execute a function corresponding to the entered button. Upon sensing an input to release the function, the processor 120 may control the power supply 410 to switch the power currently applied (e.g., the adjusted power) back to the power before the input through the button is sensed and may apply the switched-back power to the earphone 420.

The processor 120 may apply first power to the earphone 420 corresponding to sensing the coupling of the earphone 420, receive a control signal corresponding to a button of the earphone 420, corresponding to sensing an input through the button, adjust power applied to the earphone 420 to second power corresponding to receiving the control signal, convert an analog value for the button into a digital value, and execute a function corresponding to the converted digital value. When the function corresponding to the button is not used or when the button is not pressed or touched, the processor 120 may apply a minimum power to the earphone 420. When the button is pressed or touched, the processor 120 may apply a larger power than the minimum power to the earphone 420. When the function corresponding to the button is not used, the processor 120 may receive a control signal generated by pressing or touching of the button from the earphone 420, and the processor 120 may apply the minimum power (or a basic power) that enables such control signal to be recognized to the earphone 420. When the button is pressed or touched, the processor 120 may apply power for executing the function corresponding to the button to the earphone 420. Upon sensing an input to release the function, the processor 120 may switch the second power into the first power and may apply the applied power to the earphone 420.

The processor 120 may set a minimum power (e.g., 1.6V) to enable a button control signal (e.g., an interrupt request (IRQ)) of the earphone 420 to be recognized with the 4-pole earphone is coupled and may apply the same to the earphone 420. The minimum power may be variable adjusted by the manufacturer or depending on the specifications of the electronic device 101. When the user presses or touches any button provided on the earphone 420 (e.g., a call start button, call end button, volume-up button, volume-down button, or a recording button), the earphone 420 may generate an ear key press interrupt and transfer an IRQ for the button to the electronic device 101. The processor 120 of the electronic device 101, upon reception of the IRQ, may apply the power for the earphone 420 as an operation power (2.8V). The operation power may be variably adjusted by the manufacturer or depending on the specifications of the electronic device 101. The processor 120 may leave a predetermined time (e.g., a debounce time (safety margin)) to be aware which key is entered and may convert an analog value applied to the button after the predetermined time (e.g., 30 ms to 40 ms) into a digital value. When the received digital value is different from a digital value set to each button, another digital value may be obtained after a predetermined time. When the obtained digital value is a normal value, the value may be transferred from the kernel to the platform to execute a function corresponding to the button. When the user releases the currently executing function by repressing or retouching the button, the earphone 420 may generate an ear key release interrupt and transfer the same to the electronic device 101. The processor 120 may change the power applied to the earphone 420 back into the minimum power and may apply the minimum power.

Figure 5:
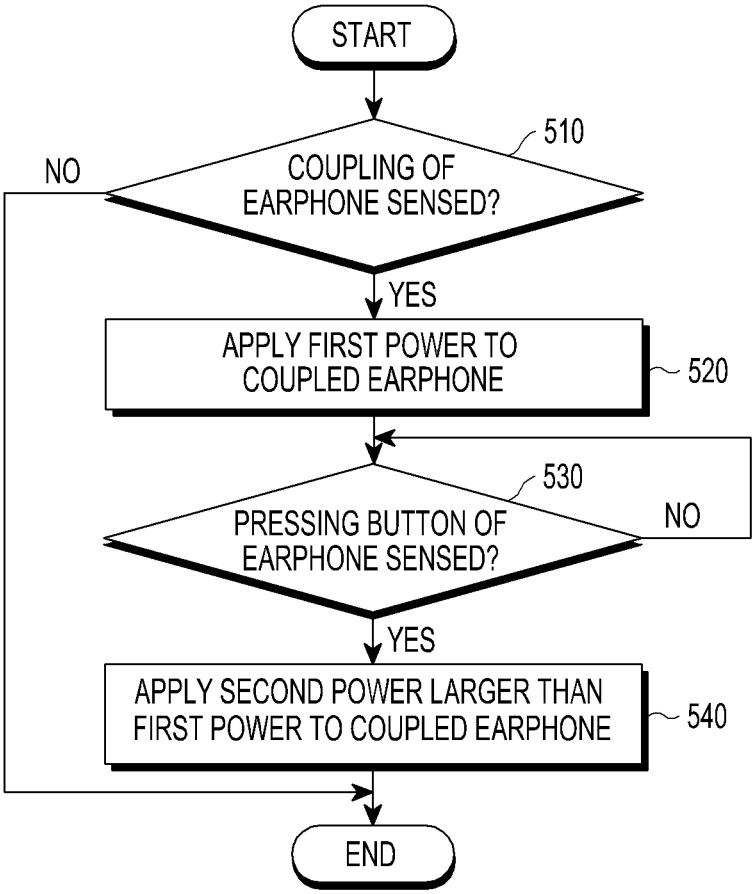
FIG. 5 is a flowchart illustrating a method for controlling power by an electronic device according to an embodiment of the present disclosure.

FIG. 5 is a flowchart illustrating a method for controlling power by an electronic device according to an embodiment of the present disclosure.

A method for controlling power by an electronic device according to an embodiment of the present disclosure is now described below in detail with reference to FIG. 5.

Upon sensing a coupling of the earphone at block 510, the electronic device 101 may apply a first power to the coupled earphone at block 520. The electronic device 101 may sense the insertion of the earphone jack. Upon sensing the coupling of the earphone, the electronic device 101 may apply to the earphone a minimum power (e.g., the first power) to sense a pressing of a button provided on the earphone. The minimum power may be a power corresponding to when a function executable by the button of the earphone is not executed. The electronic device 101 may apply the minimum power to the earphone 420, and such minimum power may be a power for outputting a sound through the output unit 423 of the earphone. The earphone may include a 4-pole earphone.

Upon sensing a pressing of the button at block 530, the electronic device 101 may apply a second power larger than the first power to the earphone connected thereto at block 540.

The button may generate different control signals as pressed or touched. The earphone 420 may transmit the generated control signal to the electronic device 101, and the electronic device 101 may determine which button has been selected or what function is intended to be executed through an analog value of the received control signal. Upon sensing an input by a pressing or touch, the button may generate a control signal to indicate that the button has been selected and transfer the generated control signal to the electronic device 101. The electronic device 101 may adjust the first power to the second power using any one of an ON/OFF scheme or a register scheme, and apply the adjusted second power to the earphone. When receiving the control signal while the first power is being applied to the earphone, the electronic device 101 may adjust the first power applied to the earphone to the second power corresponding to the received control signal and apply the adjusted second power to the earphone. The first power may be a basic power to enable recognition of the control signal or output of a sound through the earphone when the function corresponding to the button is not used, and the second power may be a power required to sense an input through the button or to execute the function corresponding to the button. The electronic device 101 may adjust the first power to the second power using any one of an ON/OFF scheme or a register scheme. The electronic device 101 may adjust the second power to the first power using any one of the ON/OFF scheme or the register scheme. The electronic device 101 may adjust the first power to the second power and the second power to the first power using at least one of the ON/OFF scheme and the register scheme. The ON/OFF scheme reduces the first power (or second power) to 0V (or cutting off the power supplied to the earphone) and then adjusts a register value to thereby adjust the second power (or first power). The register scheme directly adjusts the first power (or second power) to the second power (or first power) by adjusting a register value.

The electronic device 101 may execute a function corresponding to the sensed button. The electronic device 101 may determine which button has been pressed or what function is to be executed by comparing the converted digital value with a pre-stored digital value corresponding to each button. The electronic device 101 may compare the converted digital value with the pre-stored digital value corresponding to each button to execute a consistent function or a function corresponding to a threshold range. Upon sensing an input to release the function or receiving a control signal corresponding to the release of the function, the electronic device 101 may switch the power currently applied (e.g., the second power) back into the power before the input through the button is sensed (e.g., the first power) and may apply the same to the earphone.

Figure 6:
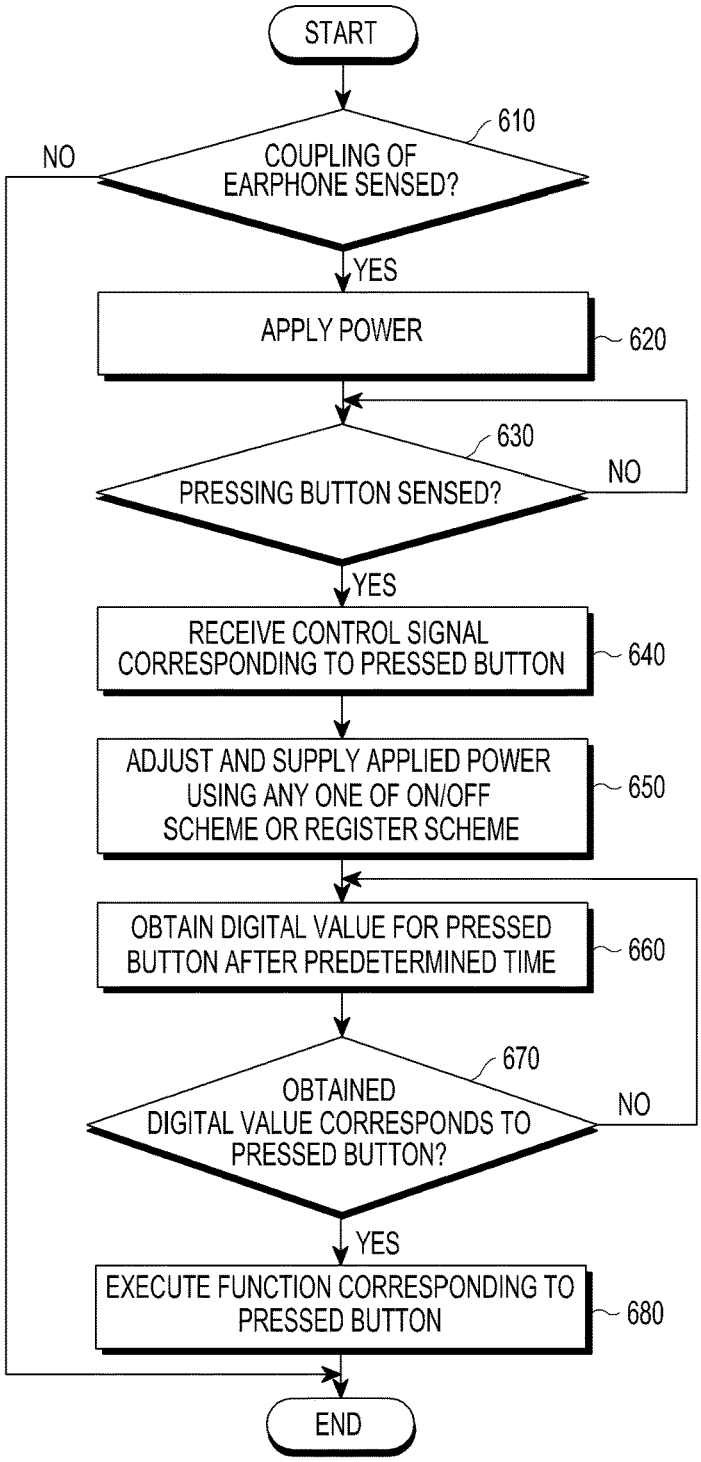
FIG. 6 is a flowchart illustrating a method for controlling power by an electronic device according to an embodiment of the present disclosure.

FIG. 6 is a flowchart illustrating a method for controlling power by an electronic device according to an embodiment of the present disclosure.

A method for controlling power by an electronic device according to an embodiment of the present disclosure is now described below in detail with reference to FIG. 6.

Upon sensing a coupling of the earphone at block 610, the electronic device 101 may apply a first power to the sensed earphone at block 620. The electronic device 101 may sense the insertion of an earphone jack. Upon sensing the coupling of the earphone, the electronic device 101 may apply a minimum power for sensing a pressing of a button provided on the earphone to the earphone. The minimum power may be a power corresponding to when a function executable by the button of the earphone is not executed. The electronic device 101 may apply the minimum power to the earphone 420, and such minimum power may be a power for outputting a sound through the output unit 423 of the earphone. The earphone may include a 4-pole earphone.

Upon sensing a pressing of the button at block 630, the electronic device 101 may receive a control signal corresponding to the pressed button from the earphone at block 640. The earphone 420 may include at least one button. The button may include at least one of a call start button, a call end button, a volume-up button, a volume-down button, and a recording button. According to an embodiment of the present disclosure, although the button is described as including at least one of the volume adjustment button, the call button, and the recording button, this is merely an example, and other various buttons that may offer the user with convenience using the earphone may be alternatively provided. Such buttons may generate different control signals as pressed or touched. The earphone 420 may transmit the generated control signal to the electronic device 101, and the electronic device 101 may determine which button has been selected or what function is intended to be executed through an analog value of the received control signal. Upon sensing an input by a pressing or touch, the button may generate a control signal to indicate that the button has been selected and transfer the generated control signal to the electronic device 101.

The electronic device 101 may adjust the applied power using any one of an ON/OFF scheme or a register scheme and apply the adjusted power to the earphone. When receiving the control signal while the first power is being applied to the earphone, the electronic device 101 may adjust the first power applied to the earphone to the second power corresponding to the received control signal and apply the adjusted second power to the earphone. The first power may be a basic power to enable recognition of the control signal or output of a sound through the earphone when the function corresponding to the button is not used, and the second power may be a power required to sense an input through the button or to execute the function corresponding to the button. The electronic device 101 may adjust the first power to the second power using any one of an ON/OFF scheme or a register scheme. The electronic device 101 may adjust the second power to the first power using any one of the ON/OFF scheme or the register scheme. The electronic device 101 may adjust the first power to the second power and the second power to the first power using at least one of the ON/OFF scheme and the register scheme. The ON/OFF scheme is a scheme to reduce the first power (or second power) to 0V (or cutting off the power supplied to the earphone) and then adjust a register value to thereby adjust the second power (or first power). The register scheme is a scheme to directly adjust the first power (or second power) to the second power (or first power) by adjusting a register value.

The electronic device 101 may obtain a digital value for the pressed button after a predetermined time at block 660. The electronic device 101 may obtain an analog value for the pressed button after a predetermined time and convert the same into a digital value. When receiving the control signal, the electronic device 101 may analyze an analog value applied after a predetermined time to determine what function the entered button may execute.

When the obtained digital value corresponds to the pressed button at block 670, the electronic device 101 may execute a function corresponding to the pressed button at block 680. The electronic device 101 may determine which button has been pressed or what function is to be executed by the button by comparing the converted digital value with a pre-stored digital value corresponding to each button. The electronic device 101 may compare the converted digital value with the pre-stored digital value corresponding to each button to execute a consistent function or a function corresponding to a threshold range. The converted digital value may be compared with a pre-stored digital value corresponding to each button, and upon being not consistent with the converted digital value or when there is no digital value corresponding to a threshold range, the process of obtaining an analog value applied for the button and converting the same into a digital value may be performed again. Upon sensing an input to release the function or receiving a control signal corresponding to the release of the function, the electronic device 101 may switch the power currently applied (e.g., the second power) back into the power before the input through the button is sensed (e.g., the first power) and may apply the switched-back power to the earphone 420.

Figure 7:
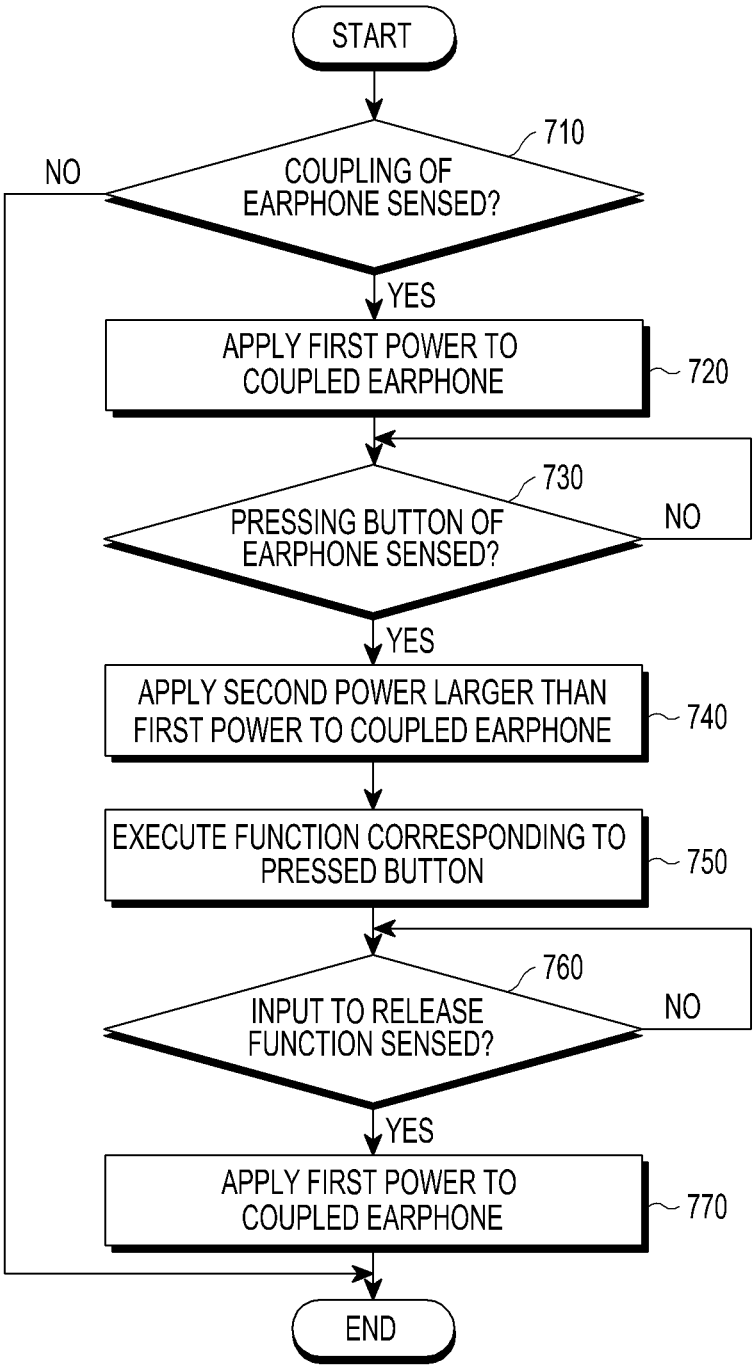
FIG. 7 is a flowchart illustrating a process for controlling power applied to an earphone corresponding to an input and release of a button of the earphone according to an embodiment of the present disclosure.

FIG. 7 is a flowchart illustrating a process for controlling power corresponding to an input and release of a button of the earphone according to an embodiment of the present disclosure.

A process for controlling power corresponding to an input and release of a button of an earphone according to an embodiment of the present disclosure is described below in detail with reference to FIG. 7.

Upon sensing a coupling of the earphone at block 710, the electronic device 101 may apply a first power to the coupled earphone at block 720. The electronic device 101 may sense the insertion of an earphone jack. Upon sensing the coupling of the earphone, the electronic device 101 may apply a minimum power (e.g., the first power) for sensing a pressing of a button provided on the earphone to the earphone. The minimum power may be a power corresponding to when a function executable by the button of the earphone is not executed. The electronic device 101 may apply the minimum power to the earphone 420, and such minimum power may be a power for outputting a sound through the output unit 423 of the earphone. The earphone may include a 4-pole earphone.

Upon sensing a pressing of the button at block 730, the electronic device 101 may apply a second power larger than the first power to the earphone connected thereto at block 740. The button may generate different control signals as pressed or touched. The earphone 420 may transmit the generated control signal to the electronic device 101, and the electronic device 101 may determine which button has been selected or what function is intended to be executed through an analog value of the received control signal. Upon sensing an input by a pressing or touch, the button may generate a control signal to indicate that the button has been selected and transfer the generated control signal to the electronic device 101. The electronic device 101 may adjust the first power to the second power using any one of an ON/OFF scheme or a register scheme and apply the adjusted second power to the earphone. When receiving the control signal while the first power is being applied to the earphone, the electronic device 101 may adjust the first power applied to the earphone to the second power corresponding to the received control signal and apply the adjusted second power to the earphone. The first power may be a basic power to enable recognition of the control signal or output of a sound or audio signal through the earphone when the function corresponding to the button is not used, and the second power may be a power to sense an input through the button or to execute the function corresponding to the button. The electronic device 101 may adjust the first power to the second power using any one of an ON/OFF scheme or a register scheme. The electronic device 101 may adjust the second power to the first power using any one of the ON/OFF scheme or the register scheme. The electronic device 101 may adjust the first power to the second power and the second power to the first power using at least one of the ON/OFF scheme and the register scheme. The ON/OFF scheme reduces the first power (or second power) to 0V (or cutting off the power supplied to the earphone) and then adjusts a register value to thereby adjust the second power (or first power). The register scheme directly adjusts the first power (or second power) to the second power (or first power) by adjusting a register value.

The electronic device 101 may execute a function corresponding to the sensed button at block 750. The electronic device 101 may determine which button has been pressed or what function is to be executed by the button by comparing the converted digital value with a pre-stored digital value corresponding to each button. The electronic device 101 may compare the converted digital value with the pre-stored digital value corresponding to each button to execute a consistent function or a function corresponding to a threshold range.

Upon sensing an input to release the function at block 760, the electronic device 101 may apply a first power to the coupled earphone at block 770. Upon sensing an input to release the function or receiving a control signal corresponding to the release of the function, the electronic device 101 may switch the power currently applied (e.g., the second power) back into the power before the input through the button is sensed (e.g., the first power) and may apply the same to the earphone.

Figure 8:
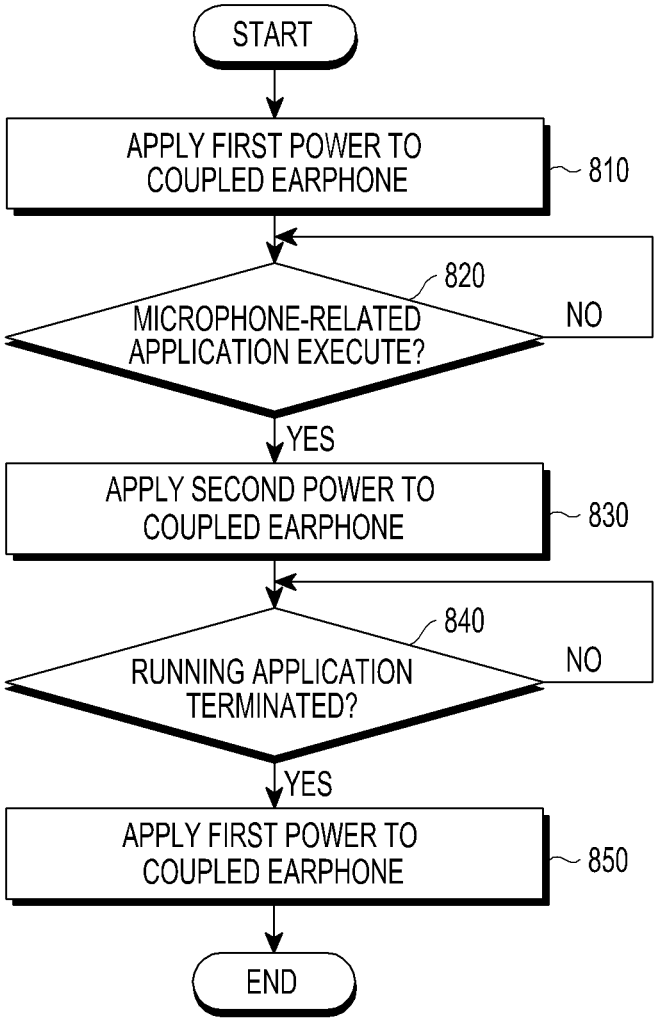
FIG. 8 is a flowchart illustrating a process for controlling power applied to an earphone corresponding to executing and terminating an application according to an embodiment of the present disclosure.

FIG. 8 is a flowchart illustrating a process for controlling power applied to an earphone corresponding to executing and terminating an application according to an embodiment of the present disclosure.

A process for controlling power applied to an earphone corresponding to executing and terminating an application according to an embodiment of the present disclosure is described below in detail with reference to FIG. 8.

The electronic device 101 may apply a first power to the coupled earphone at block 810. Upon sensing a coupling of the earphone, the electronic device 101 may apply a first power to the coupled earphone. The electronic device 101 may apply the minimum power to the earphone 420, and such minimum power may be a power for receiving a sound through a microphone of a remote controller of the earphone. According to an embodiment of the present disclosure, when an application or program is executed on the electronic device 101 to execute a function provided by the earphone, the first power may be applied to the earphone coupled to the electronic device 101.

When an application associated with the microphone is executed at block 820, the electronic device 101 may apply a second power to the earphone coupled thereto at block 830. Upon receiving a command to execute an application to use the microphone of the earphone, the electronic device 101 may apply the second power to the earphone coupled thereto. The second power may be a power to execute the application and use the earphone as a microphone. The electronic device 101 may adjust the first power to the second power using any one of an ON/OFF scheme or a register scheme. The electronic device 101 may adjust the first power to the second power using at least any one of an ON/OFF scheme and a register scheme. The ON/OFF scheme reduces the first power (or second power) to 0V (or cutting off the power supplied to the earphone) and then adjusts a register value to thereby adjust the second power (or first power). When such adjusted power is supplied to the earphone, the earphone may receive a sound or audio signal through the microphone provided on its remote controller. The earphone may transfer the received sound to the electronic device 101. According to an embodiment of the present disclosure, when a program or application associated with the earphone is executed, the electronic device 101 may apply the second power to the earphone coupled thereto.

When the application is terminated at block 840, the electronic device 101 may apply the first power to the earphone coupled thereto at block 850. Upon sensing an input to terminate the application or stopping (or releasing) the application, the electronic device 101 may switch the power currently applied to the earphone (e.g., the second power) back into the power before the application is executed (e.g., the first power) and apply the switched power to the earphone. The electronic device 101 may adjust the second power to the first power using any one of the ON/OFF scheme or the register scheme. The electronic device 101 may adjust the second power to the first power using at least any one of an ON/OFF scheme and a register scheme.

Figure 9:
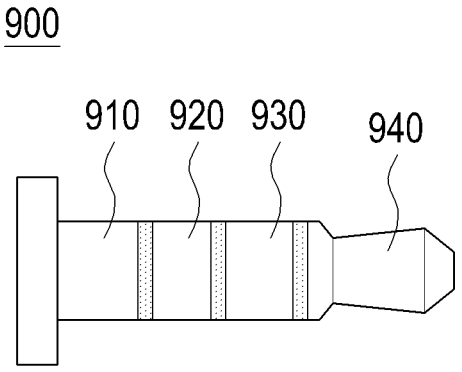
FIG. 9 is a view illustrating an exemplary structure of a jack of an earphone according to an embodiment of the present disclosure.

FIG. 9 is a view illustrating an exemplary structure of an earphone jack 900 (similar to the earphone jack 422 of FIG. 4) of an earphone according to an embodiment of the present disclosure.

Referring to FIG. 9, according to an embodiment of the present disclosure, the earphone jack 900 includes a ground terminal 910, a left channel terminal 920, a right channel terminal 930, and a microphone terminal 940. The earphone with such structure is called a 4-pole earphone. The ground terminal 910 may include a switching terminal (not shown), and the ground terminal 910 and the switching terminal may be connected to the same pole line of the earphone (not shown). The microphone terminal 940 may transfer a sound input through a microphone of the earphone to a portable terminal and may transfer a control signal for at least one button provided on the earphone to the electronic device 101. The right channel terminal 930 and the left channel terminal 920 may transfer sounds to the earphone and output the same through the earphone. According to an embodiment of the present disclosure, the earphone may include an earphone with various arrays of such terminals as well as the earphone with the terminals arranged in the order of the ground terminal 910, the left channel terminal 920, the right channel terminal 930, and the microphone terminal 940 as described above.

When the earphone jack 900 is inserted or coupled, the electronic device 101 may sense such insertion or coupling. The electronic device 101 may sense the insertion of the earphone jack 900 through an interrupt scheme. Accordingly, the earphone may generate a control signal corresponding to the coupling or decoupling of the earphone and may generate a control signal corresponding to the selection of each button provided on the earphone. The earphone may provide the generated signal to the electronic device 101.

Figure 10:
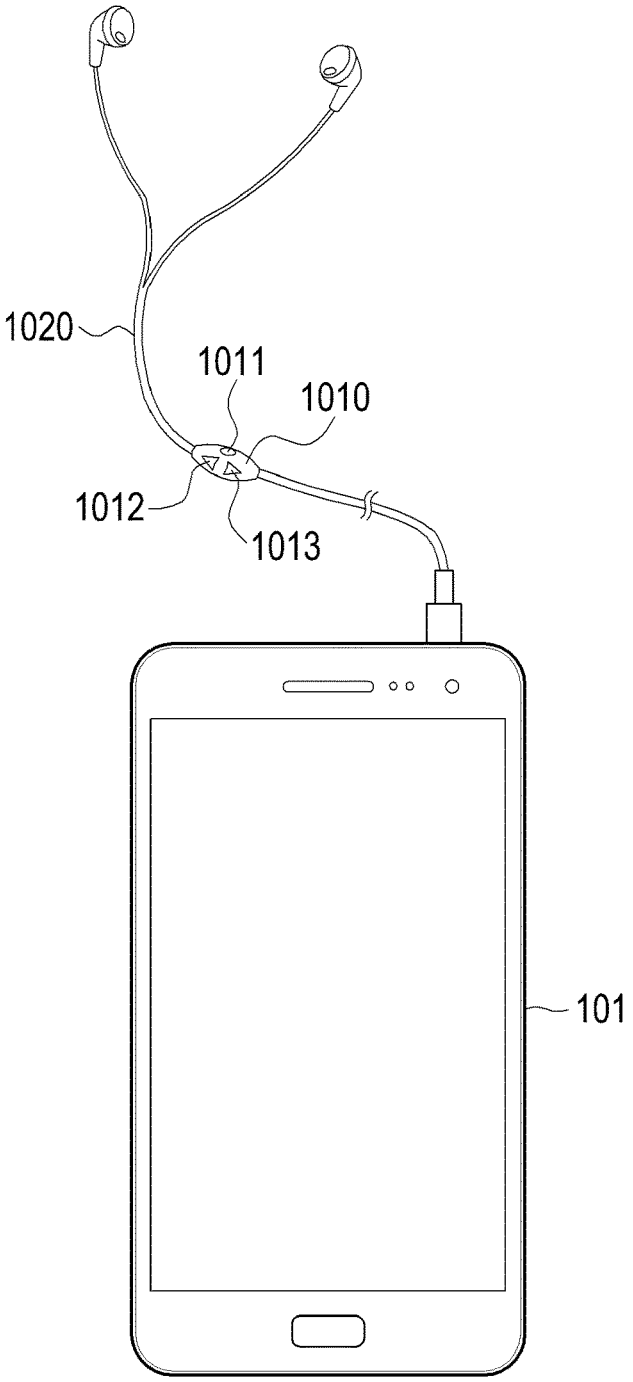
FIG. 10 is a view illustrating an example where an earphone is put in an electronic device according to an embodiment of the present disclosure.

FIG. 10 is a view illustrating an example where an earphone is inserted into an electronic device according to an embodiment of the present disclosure.

Referring to FIG. 10, according to an embodiment of the present disclosure, the earphone jack 422 may be inserted into the electronic device 101. The earphone 1020 may include a remote controller 1010. The remote controller 1010 may include a button 1011 to provide a function, e.g., starting/ending calling or recording, a button 1012 to increase the volume, and a button 1013 to decrease the volume. According to an embodiment of the present disclosure, the remote controller 1010 of the earphone 1020 may have a microphone (not shown) embedded therein. According to an embodiment of the present disclosure, various buttons or functions that may offer the user convenience using the earphone may be provided in addition to the above-described buttons or functions. Such buttons may generate different control signals as pressed or touched. The remote controller 1010 may transmit the generated control signal to the electronic device 101, and the electronic device 101 may determine which button has been selected or what function is intended to be executed through the received control signal. Upon sensing an input by a pressing or touch, the button may generate a control signal to indicate that the button has been selected and transfer the generated control signal to the electronic device 101.

Figure 11A:
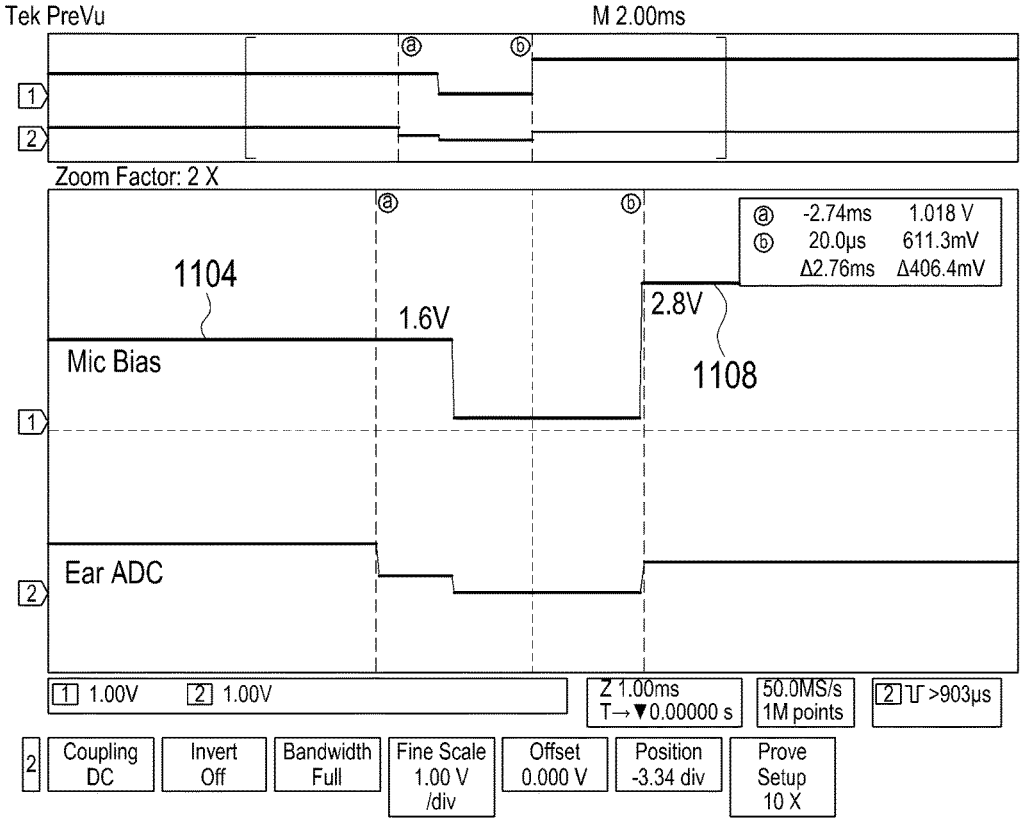
FIG. 11A is a view illustrating an exemplary ON/OFF scheme for adjusting power according to an embodiment of the present disclosure.
Figure 11B:
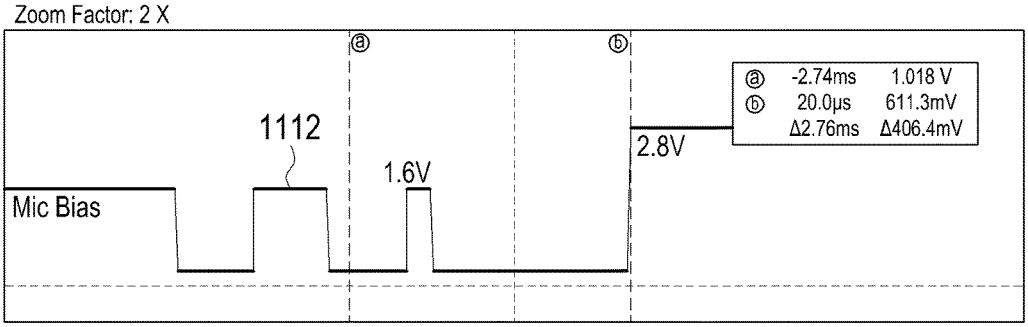
FIG. 11B is a view illustrating an exemplary PWM scheme for applying power according to an embodiment of the present disclosure.
Figure 11C:
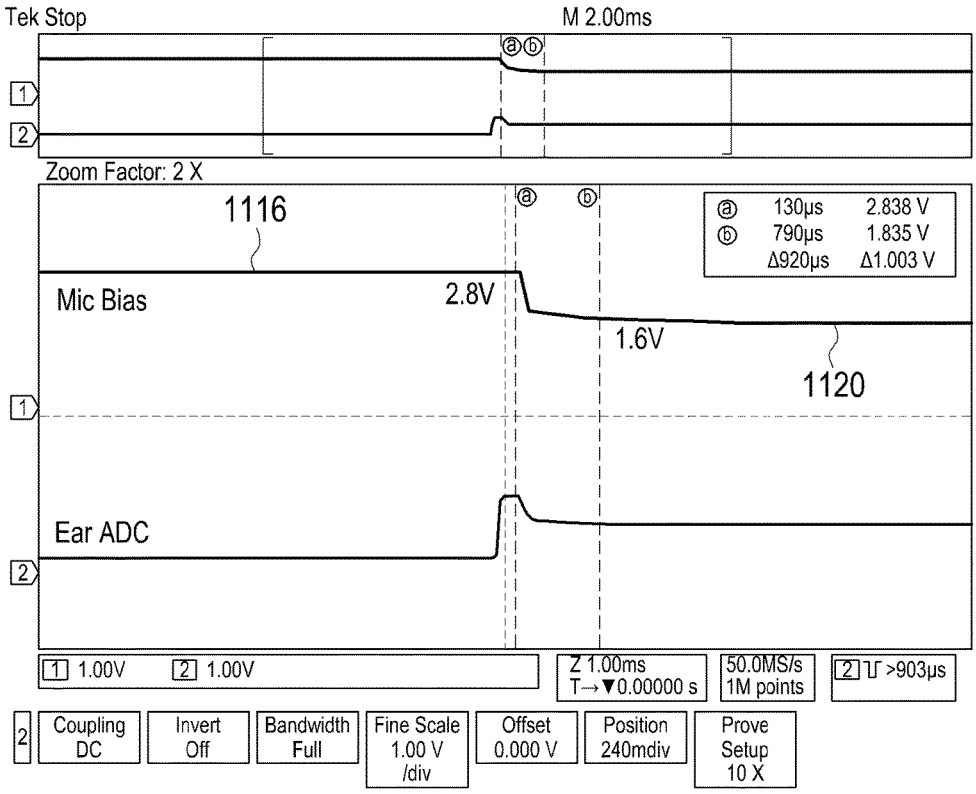
FIG. 11C is a view illustrating an exemplary register scheme for adjusting power according to an embodiment of the present disclosure.

FIG. 11A is a view illustrating an exemplary ON/OFF scheme for adjusting power according to an embodiment of the present disclosure. FIG. 11B is a view illustrating an exemplary pulse width modulation (PWM) scheme for applying power according to an embodiment of the present disclosure. FIG. 11C is a view illustrating an exemplary register scheme for adjusting power according to an embodiment of the present disclosure.

Referring to FIG. 11A, according to an embodiment of the present disclosure, a first power 1104 (e.g., 1.6V) applied to the earphone when a function corresponding to a button is not used may be adjusted to a second power 1108 (e.g., 2.8V) for sensing an input through the button and executing a corresponding function. The electronic device 101 may reduce the first power to 0V or close to 0V (or cut off the power supplied to the earphone) through an ON/OFF scheme for adjusting power (or voltage) and then adjust the same to the second power to thereby reduce a power stabilizing time. Although in FIG. 11A the first power is reduced to 0V and is then adjusted to the second power, this is merely an example. For example, the second power (e.g., 2.8V) applied to the earphone may be adjusted to the first power (e.g., 1.6V) through an ON/OFF scheme for adjusting power.

Referring to FIG. 11B, according to an embodiment of the present disclosure, when the user presses or touches a button (the button 1011 of FIG. 10), power may be applied through an oscillator to sense such input. The electronic device 101 (of FIG. 1) may repetitively apply pulse width modulation (PWM) to power applied to the earphone through the oscillator at predetermined period units. Such periodic application of the first power 1112 (e.g., 1.6V) may reduce current consumption.

Referring to FIG. 11C, according to an embodiment of the present disclosure, when the function is released by selecting the button while the function is executing, the second power 1116 (e.g., 2.8V) applied to the earphone may be adjusted to the first power 1120 (e.g., 1.6V). The electronic device 101 may adjust the second power to the first power without cutting off the power supplied to the earphone through a register scheme for adjusting power. Although in FIG. 11C the second power 1116 (e.g., 2.8V) is reduced to the first power 1120 (e.g., 1.6V), this is merely an example. For example, the first power (e.g., 1.6V) applied to the earphone may be adjusted to the second power (e.g., 2.8V) through a register scheme for adjusting power.

Figure 12:
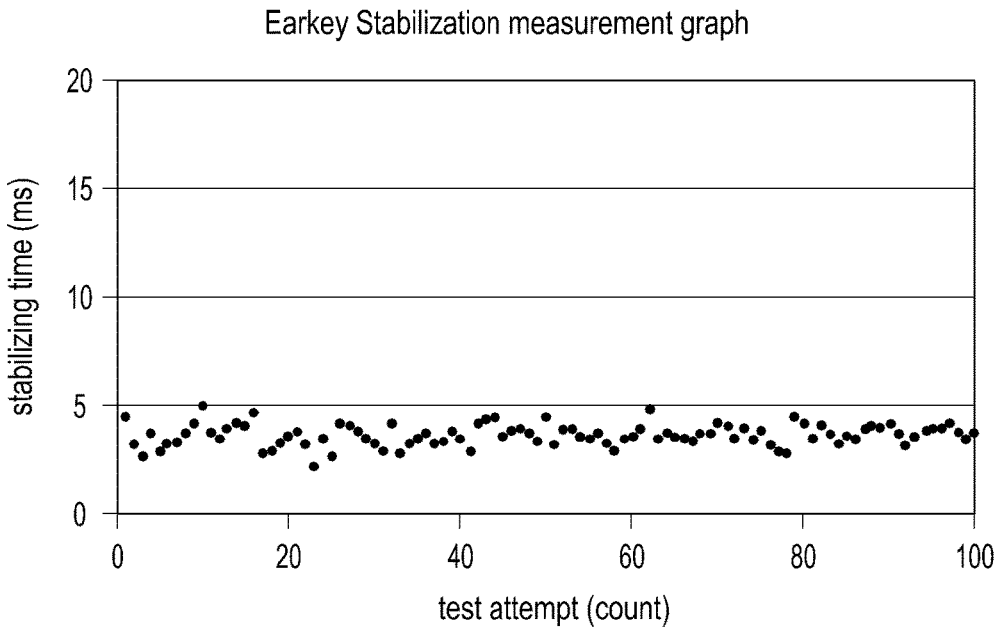
FIG. 12 is a view illustrating an example of a result of an experiment for a time to secure stability when power is controlled by an ON/OFF scheme according to an embodiment of the present disclosure.

FIG. 12 is a view illustrating an example of a result of an experiment for a time to secure stability when power is controlled by an ON/OFF scheme according to an embodiment of the present disclosure.

As evident from FIG. 12, a stability of 10 ms or less may be shown to be secured by controlling power using an ON/OFF scheme according to an embodiment of the present disclosure. When the user presses or touches a button (e.g., a call start button, call end button, volume-up button, volume-down button, or a recording button) provided on a 4-pole earphone (the earphone 420) while applying the earphone 420 with a minimum power (e.g., 1.6V) set to be able to recognize a button control signal (e.g., an interrupt request (IRQ)) of the earphone with the earphone coupled to the electronic device 101, the electronic device 101 may apply the power for the earphone as an operation power (2.8V). The stabilizing time of the earphone may be adjusted to be 10 ms or less using the ON/OFF scheme when applying the minimum power as the operation power, and thus, stability may be secured.

As is apparent from the foregoing description, according to an embodiment of the present disclosure, there are provided an electronic device and method for controlling power supplied to the earphone, which may minimize current consumed through the earphone regardless of whether the electronic device enters the sleep mode.

According to an embodiment of the present disclosure, current consumption may be minimized by supplying minimum power when the button of the remote controller of the earphone is not selected while supplying operation power when the button is selected.

According to an embodiment of the present disclosure, adjustment between the minimum power and the operation power may be made by one of an ON/OFF scheme or a register scheme, thereby enabling quick power adjustment.

The embodiments herein are provided merely for better understanding of the present disclosure, and the present disclosure should not be limited thereto or thereby. It should be appreciated by one of ordinary skill in the art that various changes in form or detail may be made to the embodiments without departing from the scope of the present disclosure defined by the following claims.

What is claimed is:

1. A method for controlling power by an electronic device, the method comprising:

sensing a coupling of an earphone;

applying a first voltage to the coupled earphone in response to sensing of the earphone;

receiving a control signal from the coupled earphone corresponding to detecting of an input through a button of the coupled earphone; and applying a second voltage larger than the first voltage to the coupled earphone based on the received control signal, wherein the applying of the second voltage comprises:

applying the second voltage to the earphone after adjusting the first voltage applied to the earphone to 0V.

2. The method of claim 1, wherein adjusting the first voltage is performed using a register scheme.

3. The method of claim 1, further comprising converting an analog value applied to the button after a predetermined time into a digital value.

4. The method of claim 3, further comprising executing the function corresponding to the button when the digital value corresponding to the button is sensed through the input.

5. The method of claim 1, wherein the second voltage is provided to execute the function corresponding to the button.

6. The method of claim 2, wherein the register scheme is to adjust a register value to adjust the applied first voltage.

7. The method of claim 1, wherein the button includes at least one of a volume adjustment button, a call button, and a recording button.

8. The method of claim 1, wherein the first voltage is a basic power to enable recognition of the control signal when the function corresponding to the button is not used, and a second power is a voltage for sensing the input through the button and executing a corresponding function.

9. The method of claim 1, further comprising, upon sensing the input to release a function, converting the second voltage into the first voltage and applying the first voltage.

10. An electronic device for controlling voltage supplied to an earphone including a button, the electronic device comprising:

a power supply; and a processor configured to:

control to the power supply to supply voltage to the earphone, sense a coupling of the earphone, apply a first voltage to the coupled earphone in response to sensing of the earphone, receive a control signal from the coupled earphone corresponding to detecting of an input through the button of the coupled earphone, and apply a second voltage larger than the first voltage to the coupled earphone based on the received control signal, wherein the processor is further configured to apply the second voltage to the earphone after adjusting the first voltage applied to the earphone to 0V.

11. The electronic device of claim 10, wherein the processor is further configured to adjust the first voltage applied to the earphone using a register scheme, and wherein the register scheme is to adjust a register value to adjust the applied first voltage.

12. The electronic device of claim 10, wherein the processor is further configured to execute the function corresponding to the button when a digital value corresponding to the button is sensed through the input.

13. The electronic device of claim 10, wherein the earphone includes a 4-pole earphone including at least one of a volume adjustment button, a call button, and a recording button.

14. The electronic device of claim 10, further comprising a memory storing a digital value corresponding to each button included in the earphone.

* * * * *